US007722333B2

(12) United States Patent
DeRosa et al.

(10) Patent No.: US 7,722,333 B2
(45) Date of Patent: May 25, 2010

(54) PORTABLE DRY AIR COMPRESSOR SYSTEM

(75) Inventors: Clemente DeRosa, Oak Forest, IL (US); David Johnson, Prospect Heights, IL (US)

(73) Assignee: Exelon Corporation, Chicago, IL (US)

( * ) Notice: Subject to any disclaimer, the term of this patent is extended or adjusted under 35 U.S.C. 154(b) by 846 days.

(21) Appl. No.: 11/286,940

(22) Filed: Nov. 23, 2005

(65) Prior Publication Data

US 2007/0116584 A1 May 24, 2007

(51) Int. Cl.
*F04B 53/00* (2006.01)

(52) U.S. Cl. ..... 417/234; 184/55.2

(58) Field of Classification Search ..... 417/234, 417/442; 128/201.25, 202.22; 73/28.01; 184/55.2

See application file for complete search history.

(56) References Cited

U.S. PATENT DOCUMENTS

| | | | | |
|---|---|---|---|---|
| 2,571,098 | A * | 10/1951 | Arnold | 184/55.2 |
| 3,983,869 | A * | 10/1976 | Suzuki | 128/204.13 |
| 4,949,715 | A * | 8/1990 | Brugger | 128/204.21 |
| 6,068,447 | A * | 5/2000 | Foege | 417/12 |
| 6,457,259 | B1 * | 10/2002 | Bilofsky et al. | 34/467 |
| 6,655,925 | B1 * | 12/2003 | Robenalt et al. | 417/234 |
| 2005/0022817 | A1 * | 2/2005 | Alvey | 128/205.22 |

OTHER PUBLICATIONS

Domnick Hunter (BA-DME) Breathing Air Purifier User Guide. pp. 1-23. Copyright domnick hunter limited 2002.

Domnick Hunter (Breathing Air Purifiers) brochure. Copyright domnick hunter limited 2003. pp. 1-7. Publication Reference: 35 02/04 Rev. 002. Stock No. 17 400 4435.

Domnick Hunter (Compressed Air Purification) brochure. Copyright domnick hunter limited 2005. Publication Reference: 00 01/05 Rev. 008. Stock No. 17 400 4400.

CompAir (Oil Injected Rotary Screw Compressors) brochure. Brochure re-order ref: 98 700-SIS NA.

Alltech (Parker Balston NMR and Ultra Dry Air Generators). Copyright 2002 Alltech Associates, Inc.

BTI—Power Source Professionals, DENYO (Sound Proof Generating Sets Powerful & Quiet), Copyright 2003, Base Ten International, pp. 1-4.

* cited by examiner

*Primary Examiner*—Devon C Kramer
*Assistant Examiner*—Peter J Bertheaud
(74) *Attorney, Agent, or Firm*—RatnerPrestia

(57) ABSTRACT

A portable air compressor assembly comprising a compressor configured to supply pressurized air along a first path at a first pressure. The compressor assembly further comprises at least first and second outlet valves. A first outlet path extends between the first outlet valve and the first path and a second outlet path extends between the second outlet valve and the first path. A first regulator is positioned along the first outlet path and is configured to regulate the pressure of air at the first outlet valve to a first outlet pressure distinct from the first path pressure. A second regulator is positioned along the second outlet path and is configured to regulate the pressure of air at the second outlet valve to a second outlet pressure distinct from the first path pressure and the first outlet pressure.

13 Claims, 8 Drawing Sheets

PORTABLE DRY AIR COMPRESSOR SYSTEM

BACKGROUND OF THE INVENTION

The present invention relates to air compressors. More particularly, the present invention relates to a multi-function dry air compressor system.

Electrical power handling equipment, such as transformers, often include a tank filed with oil in which the power handling devices or coils are disposed. The gas volume or ullage above the oil in the tank is often filled with dry air to avoid a moist air atmosphere that contaminates the oil due to oxidation and/or moisture absorption. Dry air for this purpose is generally air having a dew point of less than approximately −30° F. at one atmosphere pressure, which corresponds to a moisture content of approximately less than 235 ppm v/v. During installation or maintenance of the electrical power equipment, a high volume of the dry air is required.

To date, the dry air has generally been supplied from high pressure, refillable cylinders. However, the use of dry air cylinders has numerous drawbacks. The dry air cylinders need to be replaced on a regular basis. The cylinders are typically transported in pyramid trailers, rental cradles or semi-tube trailers. The trailers generally require a large vehicle for towing and need special hazmat endorsements prior to transport. Emptied cylinders require change over at an off-site location, thereby requiring transportation time between the electrical equipment site and the change over location. Once the cylinder trailer has arrived at the change over location, approximately 15-21 empty cylinders must be removed from the trailer and replaced by full cylinders, each full cylinder weighing approximately 200 pounds. Such change over often takes several hours such that the complete change over process, including transportation time, takes 10 or more hours which can cause significant delays during the installation or maintenance. Furthermore, the emptied cylinders also have to be returned to the vendor for refilling, resulting in additional time and costs.

In addition to using the dry air to fill the transformers or other electrical equipment, the dry air cylinders are also often used to supply breathable air to workers working in and around the transformers. In view of the criticality of the breathable air source, it is necessary to replace the cylinders more frequently to ensure the cylinders do not inadvertently empty, thereby leaving the workers without a sufficient supply of breathable air.

Accordingly, there is a need to supply dry air to a remote location that is cost effective and eliminates the need for frequent refilling of cylinders.

SUMMARY OF THE INVENTION

One aspect of the invention provides a portable air compressor assembly comprising a compressor configured to supply pressurized air along a first path at a first pressure. The compressor assembly further comprises at least first and second outlet valves. A first outlet path extends between the first outlet valve and the first path and a second outlet path extends between the second outlet valve and the first path. A first regulator is positioned along the first outlet path and is configured to regulate the pressure of air at the first outlet valve to a first outlet pressure distinct from the first path pressure. A second regulator is positioned along the second outlet path and is configured to regulate the pressure of air at the second outlet valve to a second outlet pressure distinct from the first path pressure and the first outlet pressure.

In a further aspect of the invention, the first outlet pressure is approximately 4 psi, a suitable pressure for filing of electrical power handling equipment, and the second outlet pressure is approximately 7 psi, a suitable pressure for the provision of breathable air.

In a further aspect of the invention, the compressor system further comprises a third outlet valve, a third outlet path extending between the third outlet valve and the first path, and a third regulator positioned along the third outlet path and configured to regulate the pressure of air at the third outlet valve to a third outlet pressure distinct from the first outlet pressure and the second outlet pressure. The third outlet pressure is approximately 120 psi.

In another aspect of the invention, a dryer assembly is positioned along the first path such that the air passing from the first path to the outlet paths has a dew point of less than approximately −30° F. at one atmosphere pressure, which corresponds to a moisture content of approximately less than 235 ppm v/v.

In another aspect of the invention, a filter assembly is positioned along the first path such that the air passing from the first path to the outlet paths meets at least the requirements for Grade D breathing air described in ANSI/Compressed Gas Association Commodity Specification for Air, G-7.1-1989.

Additional features and advantages of the present invention will be understood from the drawings and detailed description that follow.

BRIEF DESCRIPTION OF THE DRAWINGS

The invention is best understood from the following detailed description when read in connection with the accompanying drawings. It is emphasized that, according to common practice, the various features of the drawings are not to scale. On the contrary, the dimensions of the various features are arbitrarily expanded or reduced for clarity. Included in the drawings are the following figures.

DETAILED DESCRIPTION OF THE INVENTION

Although the invention is illustrated and described herein with reference to specific embodiments, the invention is not intended to be limited to the details shown. Rather, various modifications may be made in the details within the scope and range of equivalents of the claims and without departing from the invention.

Figure 1:
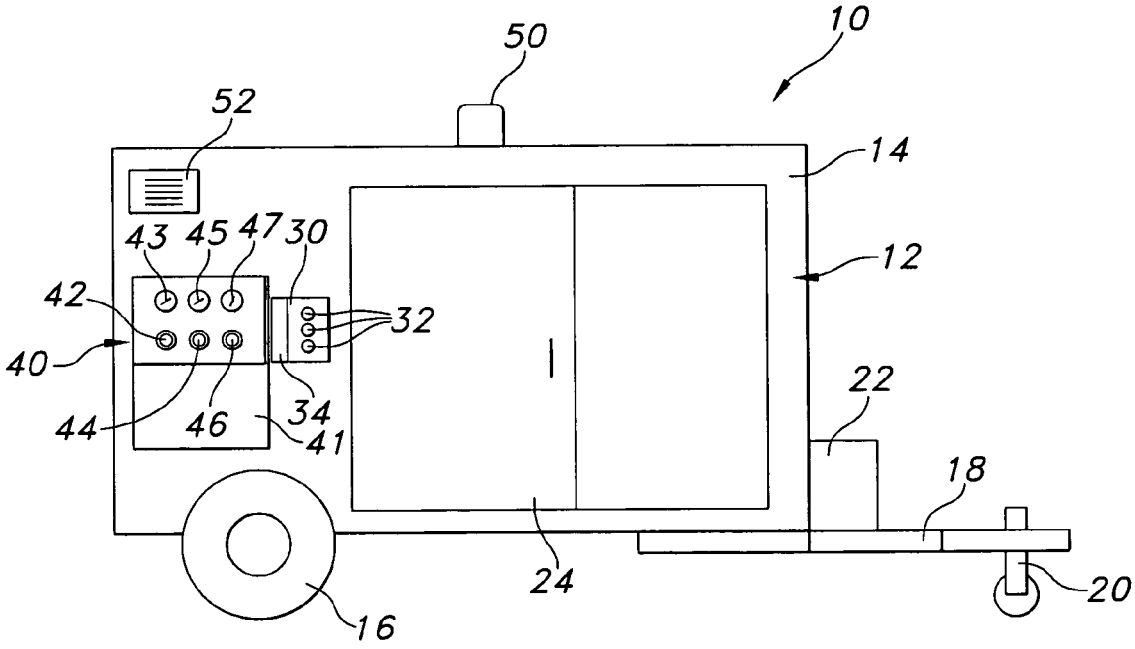
FIG. 1 is a side elevation view of a portable compressor system according to a first embodiment of the present invention.
Figure 2:
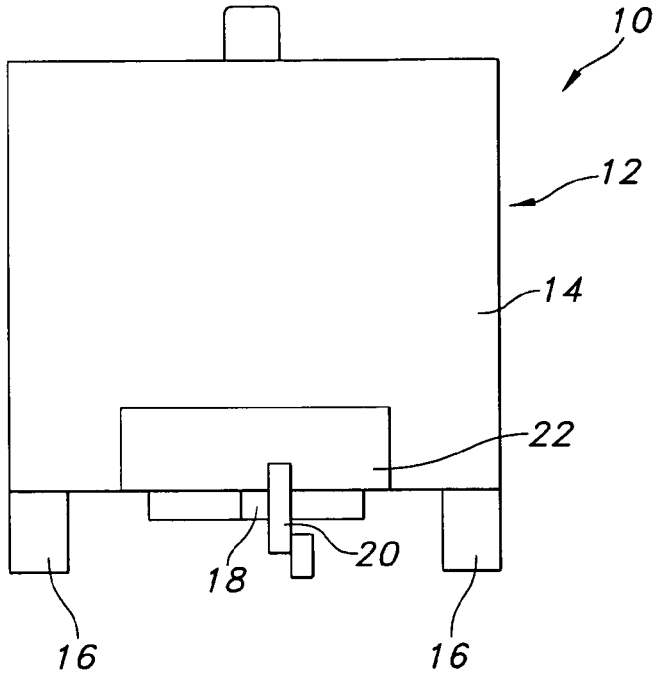
FIG. 2 is a front elevation view of the portable compressor system of FIG. 1.
Figure 3:
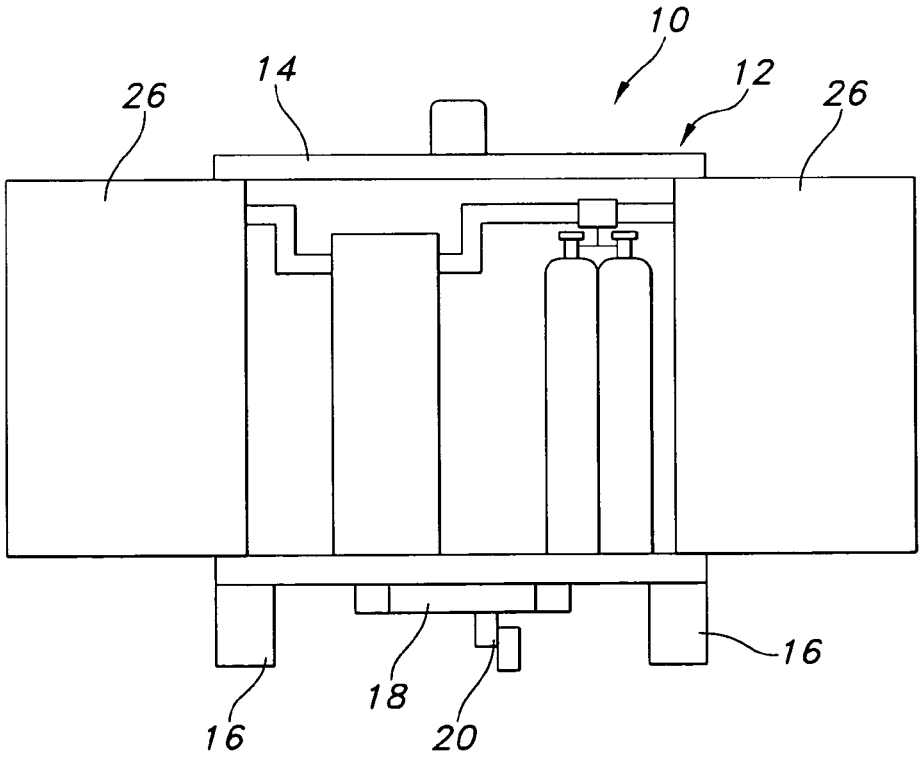
FIG. 3 is a rear elevation view of the portable compressor system of FIG. 1 with the rear doors open.

Referring to FIGS. 1-9, a portable compressor assembly 10 that is a first embodiment of the present invention will be described. As shown in FIGS. 1-3, the compressor assembly 10 includes a portable trailer 12 including an enclosure 14 supported on a base structure (not shown). The enclosure 14 and base structure are supported on wheels 16 or the like and a draw bar 18 extends from the front of the base structure and is configured to be connected to a vehicle for towing. A forward support 20, which may or may not include a wheel, is moveable between a supporting position as shown and a retracted position for towing of the trailer 12. The trailer 12 is desirably small enough that the trailer 12 may be transported without any special hazmat endorsements and may even be small enough to be towed by a car. A storage box 22 may be provided on the draw bar 18 for external storage.

The enclosure 14 is illustrated as a rectangular structure with opposed front and back panels, right and left side panels and a top surface, however, the enclosure 14 can have various configurations and is not limited to the illustrated configuration. The enclosure 14 can be manufactured from various materials including metals, plastics or composite materials. The enclosure 14 structure is preferably configured to dampen sound to minimize noise emanating from the enclosure 14. Sound dampening material, for example, insulative material, may also be provided to further reduce noise. The enclosure 14 includes various vents or louvers (not shown) to permit air flow through the enclosure 14.

The enclosure 14 of the present embodiment includes right side door panels 24 and rear door panels 26 for accessing the interior space of the enclosure 14. Other door configurations or access configurations, for example, a flip top assembly, may also be utilized. The enclosure 14 also supports an external control panel 30 and an external outlet valve assembly 40 (see FIGS. 1 and 8). The control panel 30 is associated with a central controller 28, for example, a central processing unit (CPU) or the like. Various buttons or switches 32 are provided in the control panel 30 to facilitate external control of the controller 28. A cover 34 may be provided to close the control panel 30. The valve assembly 40 of the present embodiment provides three outlet valves 42, 44 and 46 with each outlet valve configured for connection to a hose or the like. More or fewer outlet valves may be provided. A pressure indicator 43, 45 and 47 is associated with each outlet valve 42, 44 and 46 and indicates the pressure available through the respective outlet valve 42, 44, 46.

In the present embodiment, flow to outlet valve 42 is regulated to approximately 4 psi such that the air therefrom is suitable for use in filling transformers or the like. Flow to outlet valve 44 is regulated to approximately 7 psi such that the air therefrom is suitable for breathing air. Flow to outlet valve 46 is regulated to approximately 120 psi such that the air therefrom is suitable for use with pneumatic tools or the like. Regulation of each of the valves will be described in more detail hereinafter.

Figure 5:
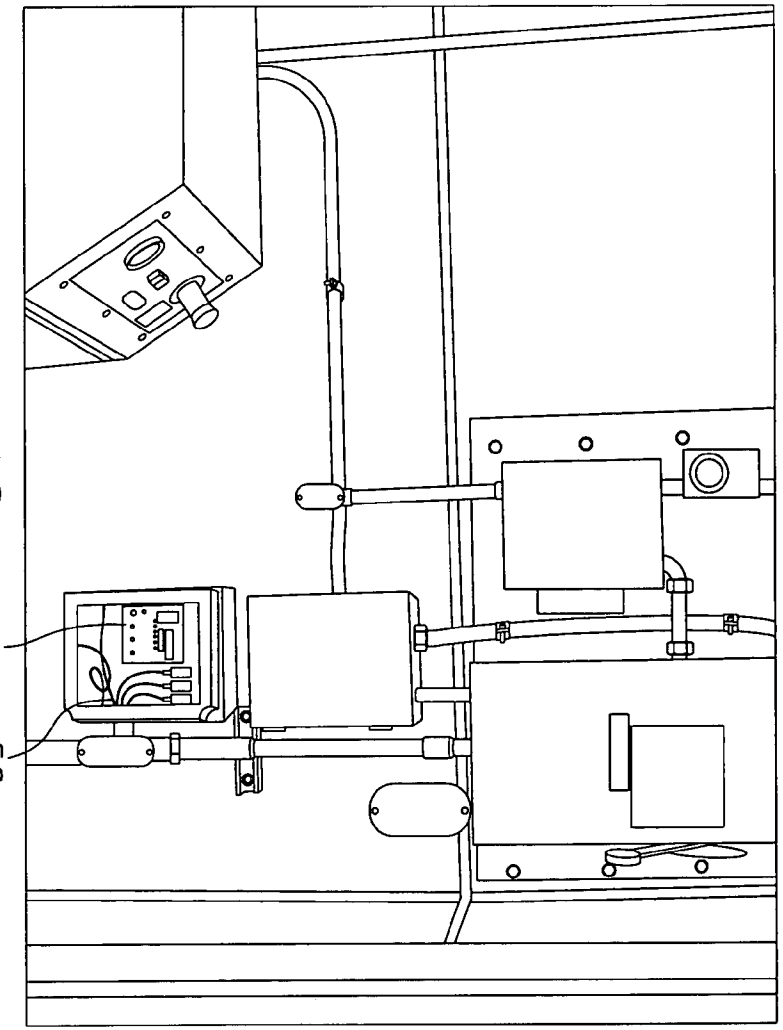
FIG. 5 is a front elevation view of a safety switch assembly of the portable compressor system of FIG. 1.

Referring to FIG. 5, the portable compressor assembly 10 of the current embodiment is powered by connection of a three phase safety switch 56 to an external power supply (not shown). The safety switch 56 has an external connector (not shown) configured for connection to the external power supply. For example, connection cords (not shown) with a first end associated with the safety switch 56 and a second free end may be stored in the external storage box 22. The cord free ends include connection assemblies, for example, muller clips, whole lugs, or bare wire leads, for connection to a power source. In applications in which the portable compressor assembly 10 is utilized to fill electrical equipment, the electrical system may be configured to accommodate a 208V, 3 phase power source such that the compressor assembly 10 may be connected directly to the available power supply. The safety switch 56 preferably includes an in-phase monitor 57 to ensure that the power source is correctly connected to the compressor assembly 10.

Figure 10:
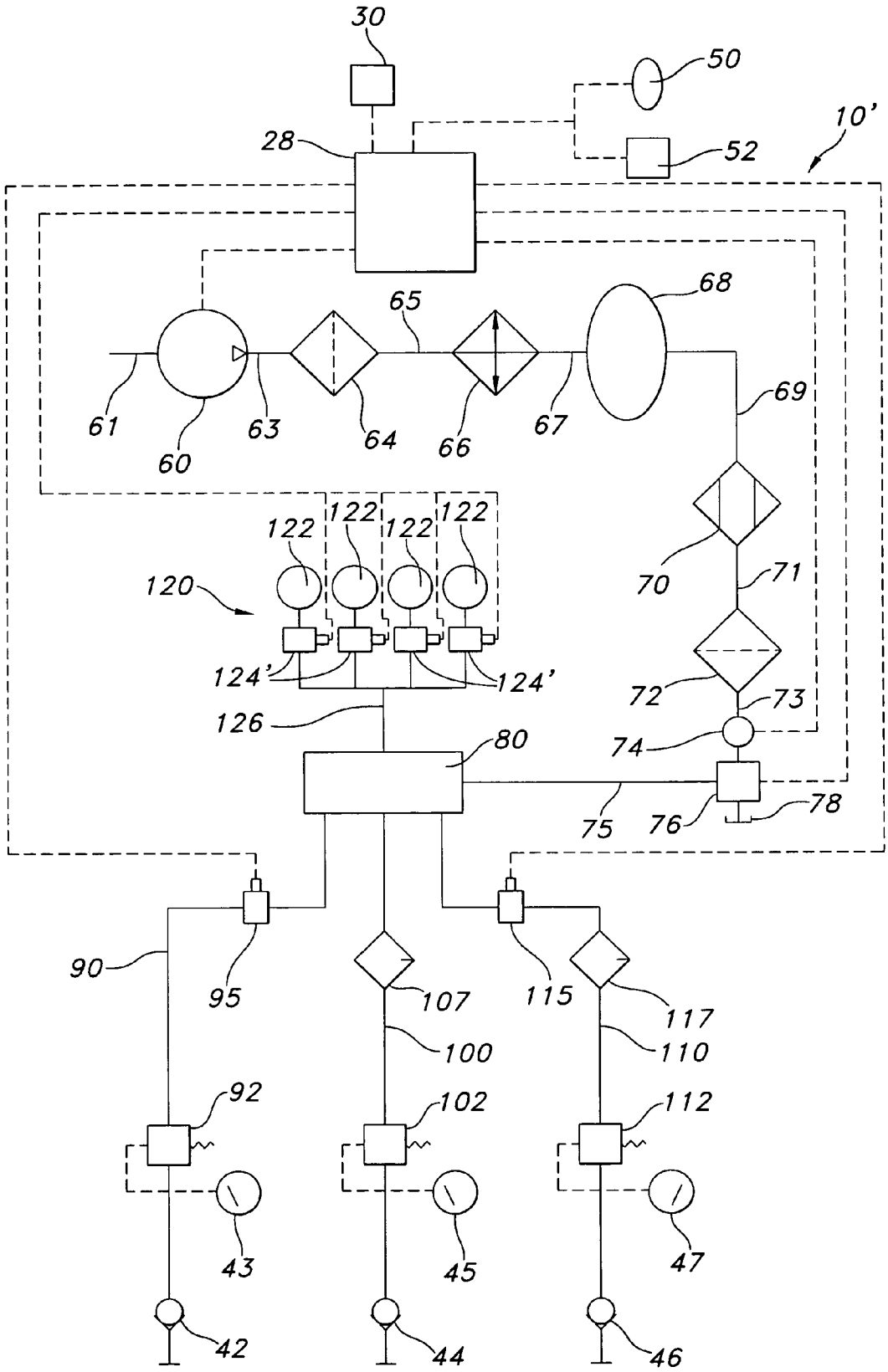
FIG. 10 is a schematic diagram of a portable compressor system that is an alternate embodiment of the present invention.
Figure 11:
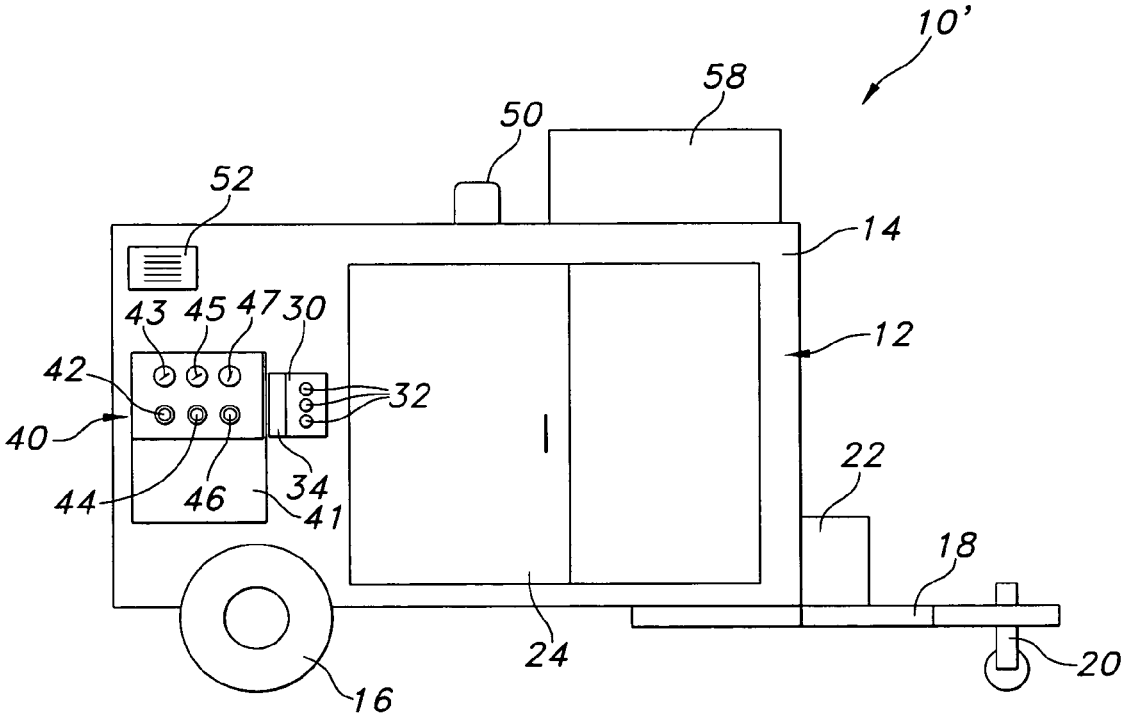
FIG. 11 is a side elevation view of a portable compressor system according to an alternate embodiment of the present invention.

The compressor assembly 10' in FIG. 11 includes a fuel powered generator 58 that is electrically connected with the compressor assembly 10' and is configured to power the various components and systems thereof. The generator 58 may be provided with electrical outlets or the like (not shown) to power other equipment that is not part of the compressor assembly 10'. In all other aspects, the compressor assembly 10' of FIG. 10 is substantially the same as that of the compressor assembly 10 of FIG. 1.

Figure 4:
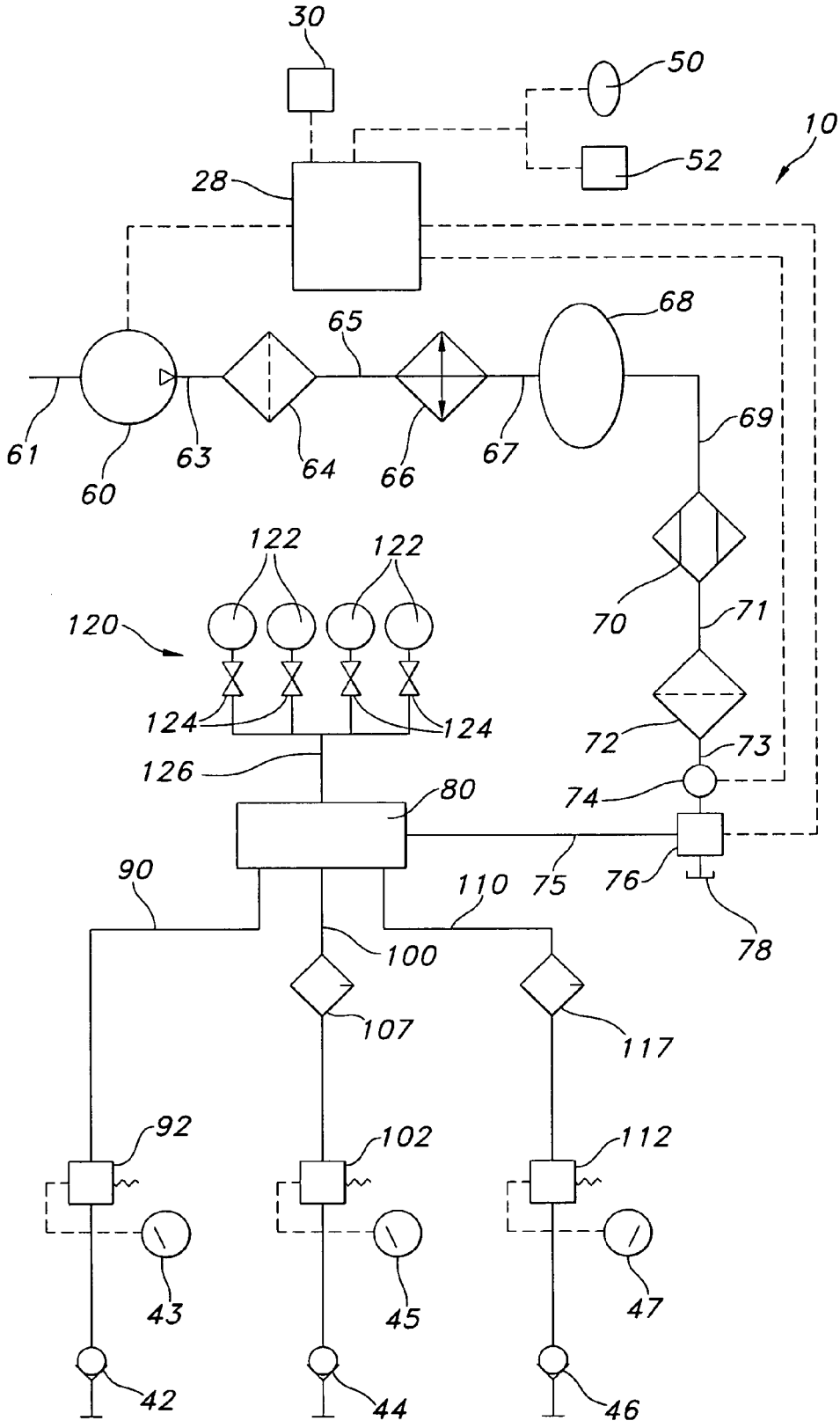
FIG. 4 is a schematic diagram of the portable compressor system of FIG. 1.
Figure 6:
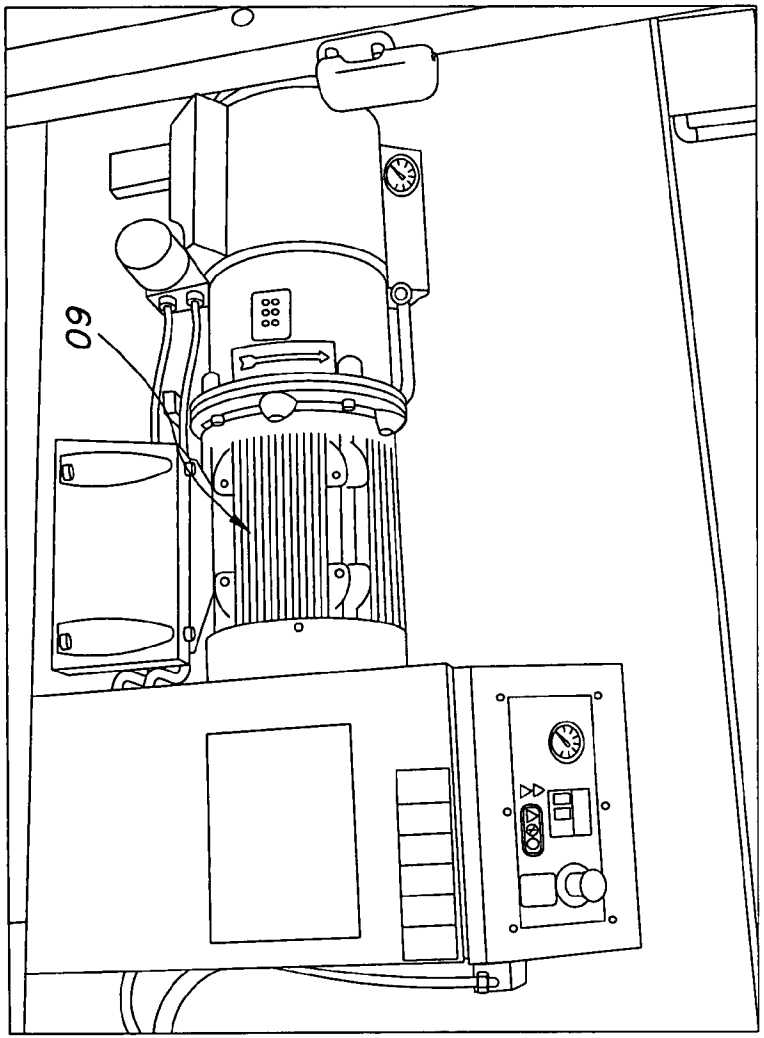
FIG. 6 is a front elevation view of the compressor of the portable compressor system of FIG. 1.
Figure 7:
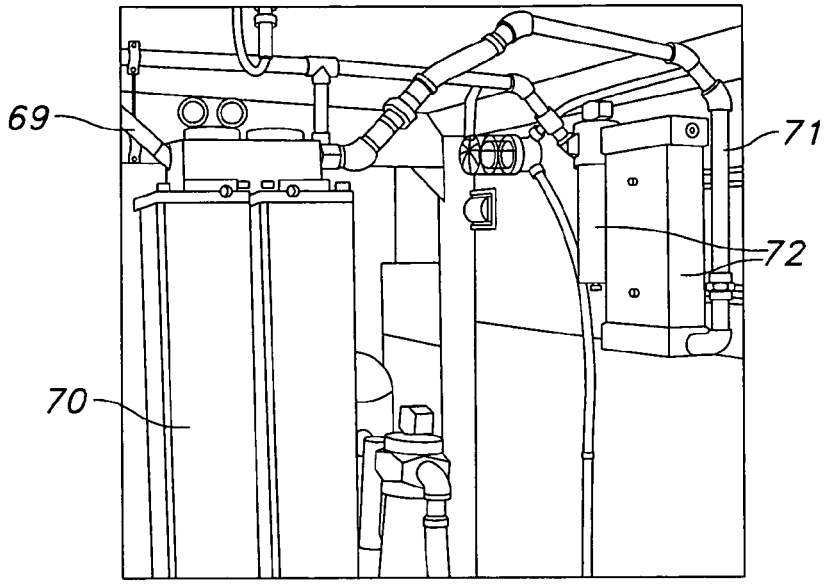
FIG. 7 is a perspective view of a portion of the filter and dryer system of the portable compressor system of FIG. 1.
Figure 8:
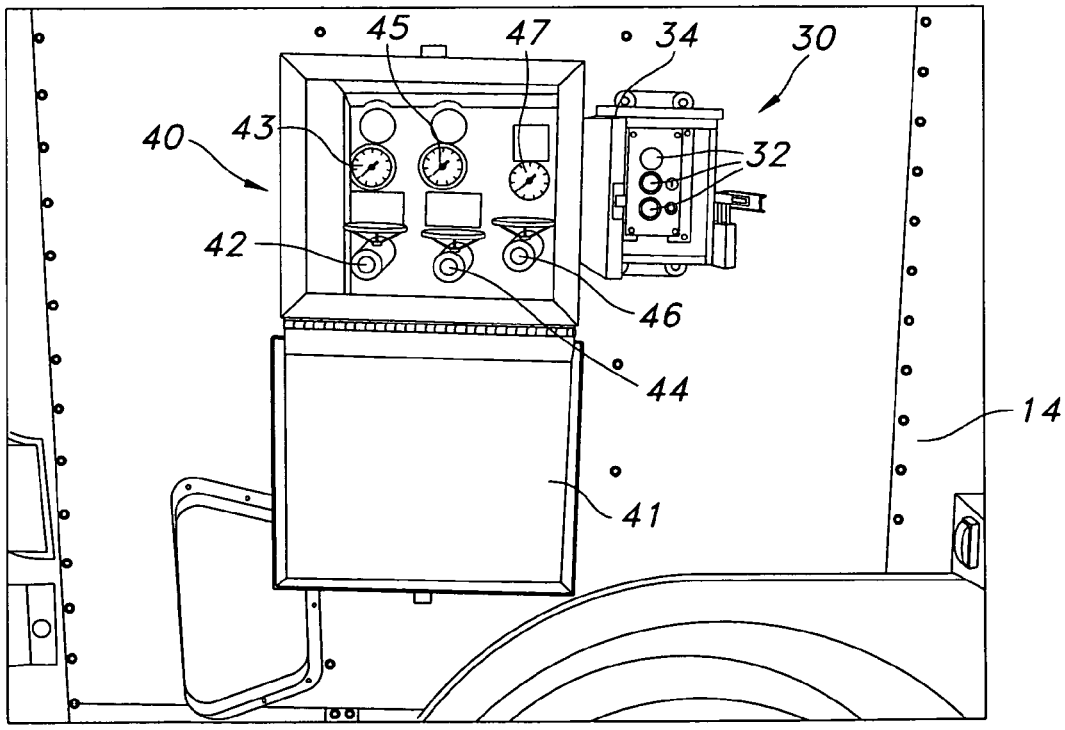
FIG. 8 is a front elevation view of the outlet valve assembly of the portable compressor system of FIG. 1.
Figure 9:
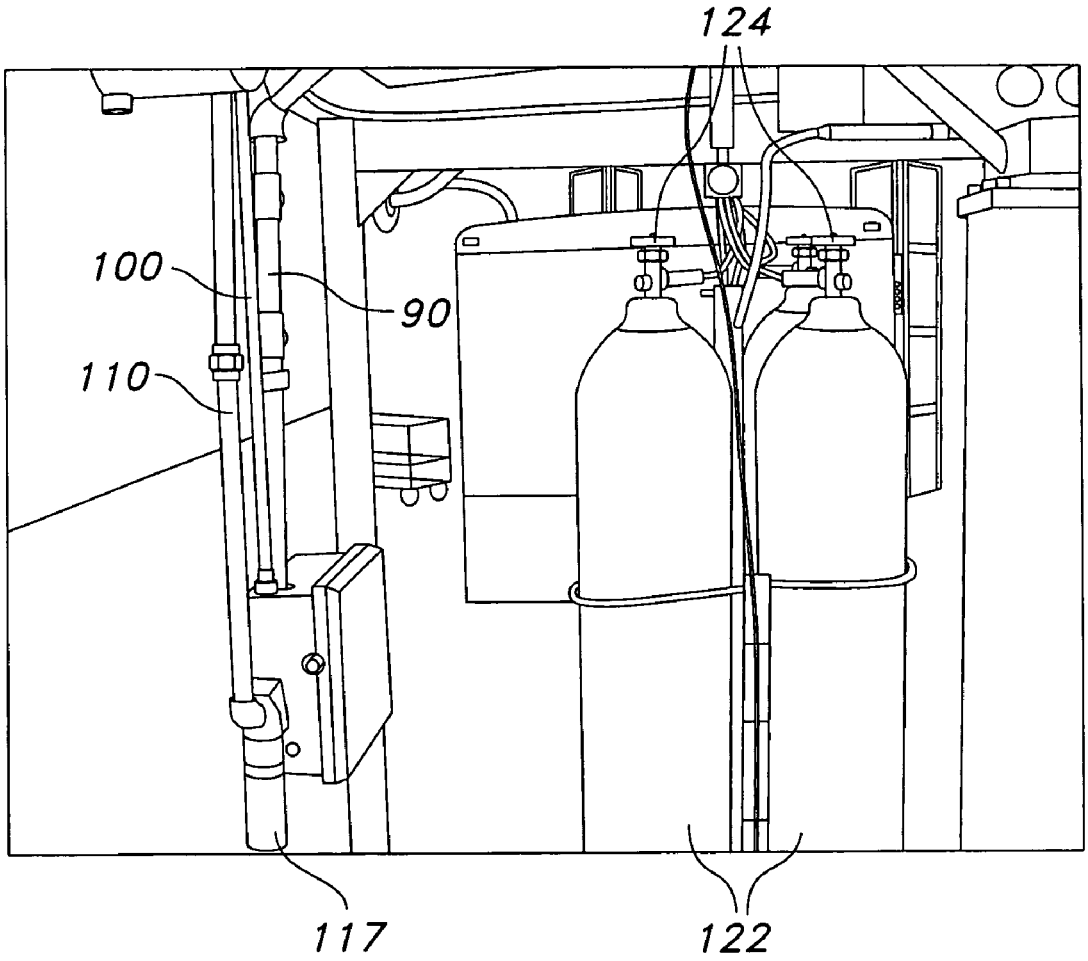
FIG. 9 is an elevation view of the backup air system of the portable compressor system of FIG. 1.

Referring to FIGS. 4 and 6, an air compressor 60 is positioned within the enclosure 14. The compressor 60 is configured to intake air generally at atmospheric pressure through inlet passage 61, compress the air, and outlet high pressure air via outlet passage 63. The compressor 60 can have various configurations, for example, the compressor 60 can be a reciprocal compressor, a rotary screw compressor, a rotary vane compressor, a centrifugal compressor or any other configuration; a single stage or multi-stage compressor; a variable speed or direct drive compressor; and an oil-flooded or oil-free compressor. A suitable compressor 60 is, for example, the illustrated V15 rotary vane compressor manufactured by CompAir of the United Kingdom. The compressor 60 is associated with the controller 28 and is controlled thereby.

Compressed high pressure air from the compressor outlet 63 travels through a filter assembly 64 via conduit 65. The filter assembly 64 is generally configured to remove oil droplets and particles or debris from the high pressure air flow. For example, the filter assembly 64 preferably includes primary and secondary oil separators (not shown). The filter assembly 64 may include additional filters, for example, charcoal filters or coalescing filters. The filter assembly 64 may be a single unit with multiple filter elements or may be separate units, each configured to filter a different substance. In the illustrated embodiment, the filter assembly 64 is formed as integral components of the V15 compressor 60, but such is not required.

The compressed air exiting the filter assembly 64 is typically hot and moist from the compression process. To remove some heat and moisture, the compressed air travels via conduit 65 through an aftercooler 66 which passes a cooling fluid, for example, air or a liquid, about the compressed air to condense the air and thereby remove heat and moisture. In the illustrated embodiment, the aftercooler 66 is formed integrally with the V15 compressor 60. Alternatively, the aftercooler 66 may be positioned downstream from the compressor 60.

The compressed air travels from the aftercooler 66 to a reserve tank 68 via conduit 67. Reserve tank 68 receives and stores compressed air such that a desired pressure, for example, around 150 psi, builds up in the tank 68. In the illustrated embodiment, the reserve tank 68 is formed integral within the V15 compressor 60, but may alternatively be formed as a stand alone structure.

In the illustrated embodiment, a dryer assembly 70 and a secondary filter assembly 72 are positioned downstream from the reserve tank 68. The positioning of the various components may be rearranged without departing from the spirit and scope of the invention. As illustrated, the compressed air travels via conduit 69 to a dryer assembly 70 (see FIG. 7). The dryer assembly 70 can include a deliquescent, refrigerant, regenerative, absorptive dryer or a combination thereof and is configured to further remove moisture from the compressed air such that dry air, having a dew point of less than approximately −30° F. at one atmosphere pressure, which corresponds to a moisture content of approximately less than 235 ppm v/v, is provided at conduit 71. Such dry air is typically sufficiently dry for use in filling the electrical equipment, for example, a transformer. Depending on the operating conditions, the air may be dryer or moister than this given dew point.

The illustrated embodiment the dried air traveling via conduit 71 to a secondary filter assembly 72 configured to remove any remaining particulate or other impurities. While the filter assembly 72 is illustrated after the dryer assembly 70, it may alternatively be provided before or both before and after the dryer assembly 70. Furthermore, the secondary filter assembly 72 may be a single unit with multiple filter elements or may be separate units, each configured to filter a different substance. In the illustrated embodiment, the dryer assembly 70 and secondary filter assembly 72 are both incorporated in a breathing air purifier manufactured by Domnick Hunter Inc. of Charlotte, N.C. and marketed as model number BA-DME060. The air purifier includes a WS-50 water separator, an AA-0080G high efficiency grade AA filter to further reduce oil and water content, an activated carbon filter to remove odors and oil vapor, a 4 stage absorptive dryer, a BAH101 catalyst purifier configured to remove carbon monoxide and an AR-0080G filter which removes any particulate that carries over from the absorptive materials. While the various filters 64 and 72, cooler 68 and dryer 70 are illustrated in a given order, the invention is not limited to such order and each of the components may be otherwise positioned. Additionally, the invention is not limited to the specific components identified herein, and more or fewer components may be utilized to clean and dry the air.

It is desirable that the secondary filter assembly 72 removes any remaining particulate such that the air traveling therefrom via conduit 73 meets at least the requirements for Grade D breathing air described in ANSI/Compressed Gas Association Commodity Specification for Air, G-7.1-1989, which includes: oxygen content (v/v) of 19.5-23.5%; hydrocarbon (condensed) content of 5 milligrams per cubic meter of air or less; carbon monoxide (CO) content of 10 ppm or less; carbon dioxide content of 1,000 ppm or less; and lack of noticeable odor.

A sensor 74 is provided in conduit 73 and is configured to monitor the purity of the air. The sensor 74 can be configured to monitor various impurities including, but not limited to, particulates, carbon monoxide, or nitrogen. The sensor 74 is connected to the controller 28. In the event the controller 28 receives a signal indicating that an undesirable level of an impurity has been detected, the controller 28 is configured to initiate an emergency sequence as described hereinafter. While a single sensor 74 is illustrated, more than one sensor 74 may be provided and the sensors may be provided at various locations.

Provided the air remains sufficiently pure, the clean, dry air flows through a control valve 76, that is normally open, to a manifold 80. The manifold 80 directs the clean, dry air along three conduits 90, 100 and 110 to the three outlet valves 42, 44 and 46, respectively. While a manifold is described herein, other piping configurations may be used. Air traveling along conduit 90 is passed through a pressure regulator 92 that is configured to regulate the air pressure available at outlet valve 42 to approximately 4 psi. The air pressure is indicated on the associated pressure indicator 43. Filling of transformers and the like generally requires low pressure, high volume dry air which is available at outlet valve 42.

Air traveling along conduit 100 similarly passes through a regulator 102 that is configured to regulate the air pressure available at outlet valve 44 to approximately 7 psi. The air pressure is indicated on the associated pressure indicator 45. Furthermore, the air is passed through a water mister 107 that slightly increases the moisture level in the breathable air at outlet valve 44. While the dry air may be suitable for breathing, extended exposure may cause drying and discomfort for workers breathing the air. It is desirable that the mister 107 add moisture such that the dew point is approximately −10° F. at one atmosphere pressure, which corresponds to a moisture content of approximately 735 ppm v/v.

Air traveling along conduit 110 also passes through a regulator 112 that is configured to regulate the air pressure available at outlet valve 46 to approximately 120 psi. The air pressure is indicated on the associated pressure indicator 47. Furthermore, the air is passed through a lubricator 117 that adds oil or another lubricator to the air such that the air at outlet valve 46 is suitable for use with pneumatic tools or the like which might be damaged by dry air. As such, the portable compressor assembly 10 provides each of the three air sources which may be desired at a transformer filling site or other application. The supply of air is continuous based on operation of the compressor 60 and does not require down time for travel or filling of dry air cylinders. Each of the regulators 92, 102 and 112 may be regulated by hand, or alternatively, may be set and regulated automatically using the controller 28.

As indicated above, the controller 28 is preferably configured to initiate an emergency sequence in the event of a failure. Such failures may include, but are not limited to, a loss of power, a compressor malfunction, or an unacceptable level of impurities in the air supply. In the event of an emergency situation, the controller 28 is configured to set off an alarm. The alarm preferably includes both a visual indicator, for example, strobe light 50, and an audible indicator, for example, siren 52. The visual and audible indicators increase the likelihood that a worker remote from the compressor assembly 10, for example, inside of a transformer, will notice the alarm.

The controller 28 is further configured to shut down the compressor 60, if it is not already shut down, and close the control valve 76 such that any remaining pressurized air in the reserve tank 66 does not flow through the conduits 90, 100, 110. A blow down valve 78 may be opened to remove any pressure remaining in the system.

To ensure that workers have sufficient breathable air to remove themselves from an enclosed work environment, a back-up dry air supply 120 is provided within the trailer 12. The back-up dry air supply 120 includes one or more tanks 122 pre-filled with breathable, pressurized dry air. The tanks 122 are connected to the manifold 80 via conduit 126. Each of the tanks 122 is typically valved off at valve 124. Upon notification of an emergency situation, a worker can open one or more of the valves 124 to allow the flow the back-up air. The back-up air flows through conduit 126, through manifold 80 and to the conduits 90, 100, 110. The back-up air traveling through conduit 100 will also receive moisture from mister 107.

To maximize the duration of breathable air, it is preferred that workers stop demand of the filling air and tool air through outlet valves 42 and 46. To ensure that workers terminate use of the filling air and tool air, the embodiment illustrated in FIG. 10 includes solenoid valves 95 and 115 in conduits 90 and 110, respectively. Upon activation of the emergency sequence, the controller 28 is configured to close valves 95 and 115 such that only conduit 100 is open and all back-up air is limited to use as breathable air through outlet valve 44. To further automate the system, in the embodiment illustrated in FIG. 10, each of the valves 124 is replaced with a solenoid valve 124' such that the controller 28 can automatically open one or more of the back-up air tanks 122 upon activation of the emergency sequence.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed is:

1. A portable air compressor assembly comprising:

a compressor configured to supply pressurized air along a first given path at a first given pressure;

a dryer assembly positioned along the first given path and configured to dry the pressurized air supplied by the compressor along the first given path;

at least first and second outlet valves;

a first outlet path extending between the first outlet valve and the first given path, the first outlet path for providing a first portion of the dry air for output at the first outlet valve;

a second outlet path extending between the second outlet valve and the first given path;

a water mister positioned along the second outlet path and configured to lubricate a second portion of the dry air for output at the second outlet valve to a dew point of approximately −10° F. at one atmosphere pressure;

a first regulator positioned along the first outlet path and configured to regulate the pressure of air at the first outlet valve to a first outlet pressure distinct from the first given pressure; and a second regulator positioned along the second outlet path and configured to regulate the pressure of air at the second outlet valve to a second outlet pressure distinct from the first given pressure and the first outlet pressure.

2. The compressor assembly of claim 1 wherein the first outlet pressure is approximately 4 psi and the second outlet pressure is approximately 7 psi.

3. The compressor assembly of claim 1 further comprising a third outlet valve, a third outlet path extending between the third outlet valve and the first given path, and a third regulator positioned along the third outlet path and configured to regulate the pressure of air at the third outlet valve to a third outlet pressure distinct from the first outlet pressure and the second outlet pressure.

4. The compressor assembly of claim 3 wherein the first outlet pressure is approximately 4 psi, the second outlet pressure is approximately 7 psi and the third outlet pressure is approximately 120 psi.

5. The compressor assembly of claim 1 wherein the dryer assembly is configured to dry the air passing from the first given path to the outlet paths to a dew point of less than approximately −30° F. at one atmosphere pressure.

6. The compressor assembly of claim 1 further comprising a filter assembly positioned along the first given path such that the air passing from the first path to the outlet paths meets the requirements for Grade D breathing air described in ANSI/Compressed Gas Association Commodity Specification for Air, G-7.1-1989.

7. The compressor assembly of claim 1 wherein an emergency sequence is activated upon detection of a failure.

8. The compressor assembly of claim 7 wherein the failure includes a loss of power, a compressor malfunction or detection of an impurity in the air supply.

9. The compressor assembly of claim 8 further comprising a sensor positioned along the first path and configured to detect impurities in the air traveling therethrough.

10. The compressor assembly of claim 9 wherein the impurities include at least one of particulate, carbon monoxide or nitrogen.

11. The compressor assembly of claim 7 wherein the emergency sequence includes stopping the compressor.

12. The compressor assembly of claim 11 further comprising a back-up source of dry air and wherein the emergency sequence includes fluidly interconnecting the back-up source to at least one of the outlet paths.

13. The compressor assembly of claim 3 wherein an oil lubricator is positioned along the third outlet path and configured to add oil to a third portion of the dry air for output at the third outlet valve.

* * * * *